US006174028B1

(12) United States Patent
Yang et al.

(10) Patent No.: US 6,174,028 B1
(45) Date of Patent: Jan. 16, 2001

(54) INFANT ROCKING CHAIR

(75) Inventors: Cheng-Fan Yang; Kung-Neng Chang, both of Tai Pao (TW)

(73) Assignee: Link Treasure Limited (VG)

( * ) Notice: Under 35 U.S.C. 154(b), the term of this patent shall be extended for 0 days.

(21) Appl. No.: 09/323,760

(22) Filed: Jun. 1, 1999

(51) Int. Cl.[7] ..... A47C 3/02

(52) U.S. Cl. ..... 297/258.1; 280/642; 280/647; 280/657; 280/658; 297/270.5; 297/271.6

(58) Field of Search ..... 297/271.6, 270.2, 297/270.5, 130, 183.7, 173, 376, 374, 51, 16.1, 258.1; 280/30, 641, 642, 647, 657, 649, 650, 658, 655, 47.31, 47.38, 47.18, 47.24, 47.29, 47.27

(56) References Cited

U.S. PATENT DOCUMENTS 525,187 * 8/1894 Burkholder ..... 297/271.6 X
1,228,967 * 6/1917 Rho ..... 297/270.5 X
1,421,260 * 6/1922 Kurnick ..... 297/270.5 X
3,269,771 * 8/1966 Erdos ..... 297/271.6 X
4,606,550 * 8/1986 Cone ..... 280/642
5,364,119 * 11/1994 Leu ..... 280/650 X
5,988,669 * 11/1999 Freese et al. ..... 280/642

* cited by examiner

*Primary Examiner*—Peter M. Cuomo
*Assistant Examiner*—Stephen Vu
(74) *Attorney, Agent, or Firm*—W. Wayne Liauh

(57) ABSTRACT

The present invention is an infant rocking chair, which can be adapted for young children and provide either the rocking or swing motion. The present invention comprises a collapsible device that can cause the state of infant rocking chair to be converted into either a folded state or an unfolded one, by which the user can convert the infant rocking chair into the collapsible state when the infant rocking chair is not used and reduce the space occupied by the same for a convenient storage. Moreover, the infant rocking chair according to the present invention further comprises a support leg for converting the state of the rocking chair into a swing position or a fixed position.

6 Claims, 9 Drawing Sheets

INFANT ROCKING CHAIR

FIELD OF THE INVENTION

The present invention relates to an infant rocking chair, especially to a collapsible structure of the infant rocking chair that can make conversions between the states of use.

BACKGROUND OF THE INVENTION

An infant rocking chair as known to the art such as in the U.S. Pat. No. 5,203,611 has a resilient iron rack to be folded into an interconnected single member of a seat support and a base support with an inclined angle included therebetween. The seat support can be mounted with a soft seat mat upon the seat support and the base support can be displaced horizontally on the ground. By that infants can be seated on the seat mat that can be caused to rock induced by the resilient characteristic of the seat support.

However, the structure of the rocking chair according to the above-mentioned patent is not collapsible due to the integration of the seat support and the base support into a single member, which necessitates producers a larger space of occupation when in storage or in the packed transport and can cause difficulties in using for the general users. Therefore, the infant rocking chair with a foldable or collapsible structure comes up in the following products. The art of an infant rocking chair of the collapsible type is disclosed in the U.S. Pat. No. 5,269,591 comprising a base frame portion with a fix member on the upper and a seat back support member on the top thereof, a foldable connector assembly mounted on the middle of the seat back support member, a seat pad support member on the opposite inner sides located on the top of the base frame portion, transverse members stretched across inner sides of the base frame portion, and a base frame support member mounted on the rear of the base frame portion. Both the seat pad support member and the seat back support member can be covered with a soft pad, and infants can be seated thereon to sway forward and backward.

The connector assembly in said structure can cause the seat back support member to be folded to occupy less storage space and the inclined angle of the rocking chair can be adjustable thereby.

The aforesaid rocking chair structure is advantageous in the adjustable inclination of the seat back support member as well as the foldable same due to the connector assembly installed thereon; however, the operative inconvenience in folding the rocking chair leads to the requirement for further improvement.

SUMMARY OF THE INVENTION

For resolving the aforesaid problems, it is the objective of the present invention to provide an infant rocking chair comprising a base frame support member with a fix frame and a collapsible frame mounted on the front and the rear thereof, respectively. The fix frame comprises a front support member and the collapsible frame comprises a rear support member. Both top ends of the rear support member and the front support member are pivoted onto a positioning part. The seat back support member is connected to the positioning part via an arched sliding member. A hook member mounted on the seat back support member can be pulled by a handle to induce a lower shaft of the hook member to be out of blocking slots in the positioning part through which the inclination angle of the seat back support member can be adjusted. Moreover, a collapsible device installed on the end of the rear support member comprises a pivoted joint encasing tube with a push member. By pressing the push member on the pivoted joint encasing tube, the collapsible device can actuate a fixation block member mounted on the end of a joint member connected to the pivoted joint encasing tube to be away from a fixation slot in the collapsible frame. The rear support member can be thereby moved backward to be collapsed. Additionally, a support leg installed under the collapsible frame can be used to change the inclination angle of the seat back support member and collapse the rocking chair. Apart from that, the transformation in the seat types dependent on the practical need can be made feasible through this advanced design.

The art according to the present invention lies in the provision of the improved structure. The structure comprises a base frame support member with two flanks bent upward in the arched shape, a tray pivotally mounted between the two opposite front support members with front ends mounted in the positioning part, a rear support member mounted on the under rear of the positioning part. The invention is characterized in that:

The top edge of the positioning part is in a form of arc-shaped portion with an arc-shaped slot thereon. A plurality of blocking slots on the arched flank top of the positioning part lie beneath the arc-shaped slot. The top portion of the positioning part takes the form of a sliding slot accommodated with an arc-shaped slider member and the bottom end of the seat back support member is inserted into an encasing tube installed on the slider member.

A long slot adapted for use in the middle of the seat back support member is past through by a shaft installed on an encasing block member located outside the long slot. The seat back support member further comprises a hook member consisted of a hook portion catching the shaft, a vaulted handle with its two wings' ends mounted on the block member and a hook plate on the bottom of the hook member. The hook plate has a long through hole being past through by a shaft and a spring member on the bottom thereof with one end catching the shaft of the positioning part;

The collapsible frame installed on the rear end of the base frame support member comprises an insertion slot under the front thereof, an accommodation slot, and a separator member coming between the insertion slot and the accommodation slot. The base frame support member is inserted into the insertion slot and the tail end of a support leg is pivoted into the accommodation slot.

The collapsible device mounted on the tail end of the back support member comprises two joint block members on both sides thereof. The front ends of the joint block members take the form of a front encasing tube, and the opposite inner sides of the same take the form of a side encasing tube. The back support member passes through and fixedly connected to the front encasing tube and an insertion joint member passes into the side encasing tube of the joint block members. Two transverse slots are mounted opposite beside the middle of the insertion joint member. The pivoted joint encasing tube comprising the push member is pivoted to the transverse slot by a shaft. One end of the joint member is fixedly pivoted to the shaft, the other end fixedly mounting to the fixation block member located on the insertion joint member. The fixation block member further comprises two opposite transverse slots and a spring member. The shaft passes through the joint block members, insertion joint member, and then into the transverse slots in the fixation block member. The end of the spring member is pressed by the flank of the shaft.

The present invention is also characterized in that:

The support leg is pivoted into the accommodation slot in the collapsible frame and the end of the same takes the form of an arc slot. The flank of the support leg takes the form of an arched breach. The area covered by the arched breach takes the form of a resilient member comprising a protrusion point being matched and fixed into a fixation depression slot on the end of a cut slot installed on the inner side of the accommodation slot.

The present invention is still characterized in that:

An impedance block member is mounted on the inner of the rear on the collapsible frame and located in an arc slot formed by the rear of the support leg. In addition, a transversely stretched track is set on the inner side of the upper of the collapsible frame and a through slot is cut through and along the track in the purpose of reducing the material cost.

For the full comprehension of the objectives, shape characteristics, and function according to the present invention, it will be further described accompanied with the attached illustrations.

BRIEF DESCRIPTION OF THE ATTACHED DRAWINGS

PREFERRED EMBODIMENT OF THE PRESENT INVENTION

Figure 1:
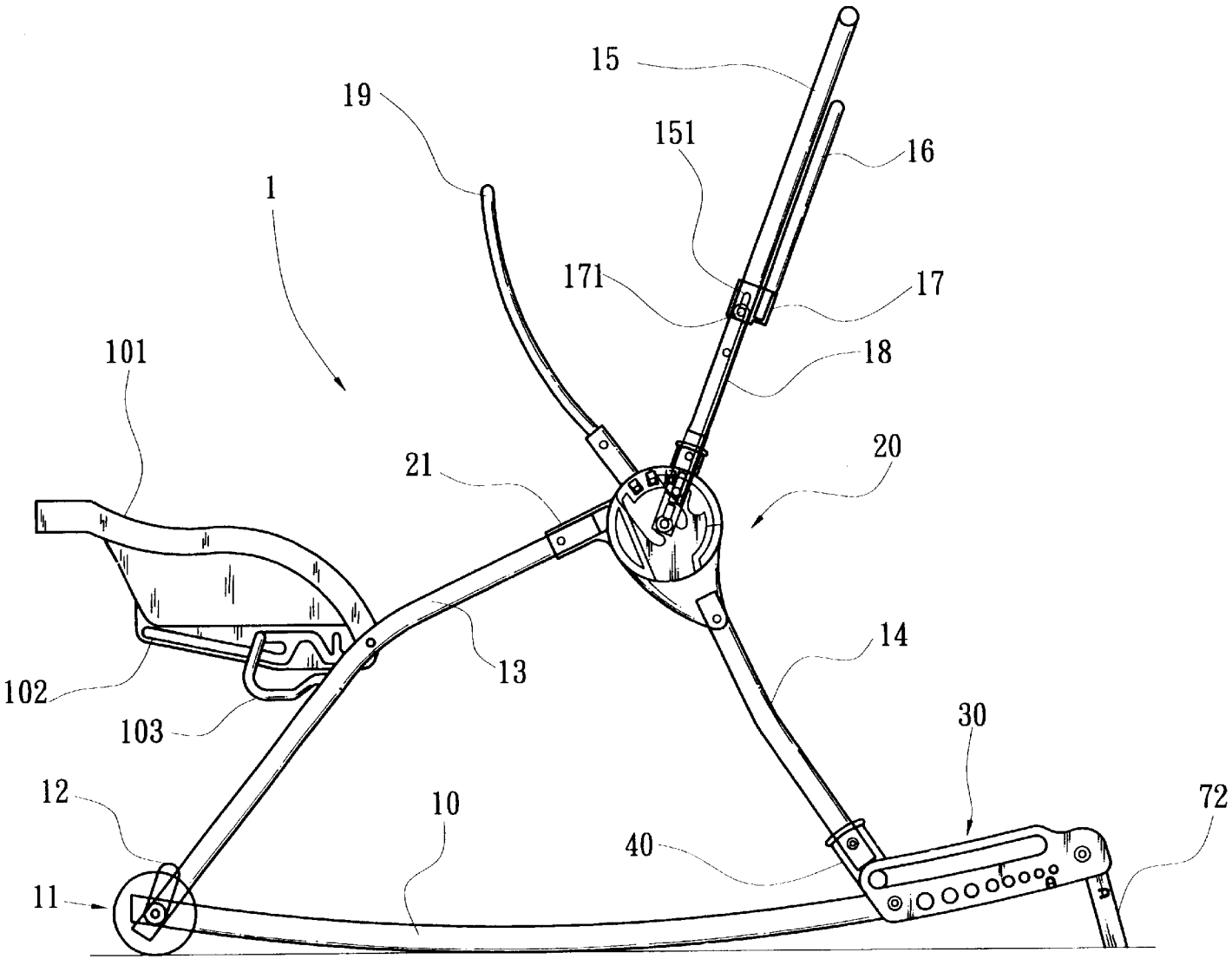
FIG. 1 is the side view of a infant rocking chair according to the present invention.

The side view of the present invention is as illustrated by FIG. 1. The structure according to the present invention comprises a base frame support member 10 with two ends bent upward in the arched shape and a fixation part 11 on the front of the base frame support member 10. The rear of the base frame support member 10 is mounted on the collapsible frame 30. By the connection of two fixation part 11, a transverse support member 12 is mounted between the two fixation frames 11 and two opposite front support members 13 are installed on the fixation part 11. A tray 101 is pivotally mounted between the two opposite front support members 13. An inclination adjustment slot 102 in the torturous and foldable form is set on the bottom the tray 101. A carrier support member 103 is installed between the two front support members 13 and passes through the inclination adjustment slot 102 to change the inclination angle of the tray 101 in a limited manner.

As referred to FIG. 1, the front ends of the front support members 13 are mounted in the positioning parts 20. Two rear support member 14 are mounted on the under rear of the positioning parts 20. The bottom of the rear support member 14 is fixed to a joint leg block 40 mounted on the front of the collapsible frame 30. In addition, a seat back support member 15 is installed on the top of the positioning part 20 and can be inclined backward to adjust the inclination angle.

Figure 2:
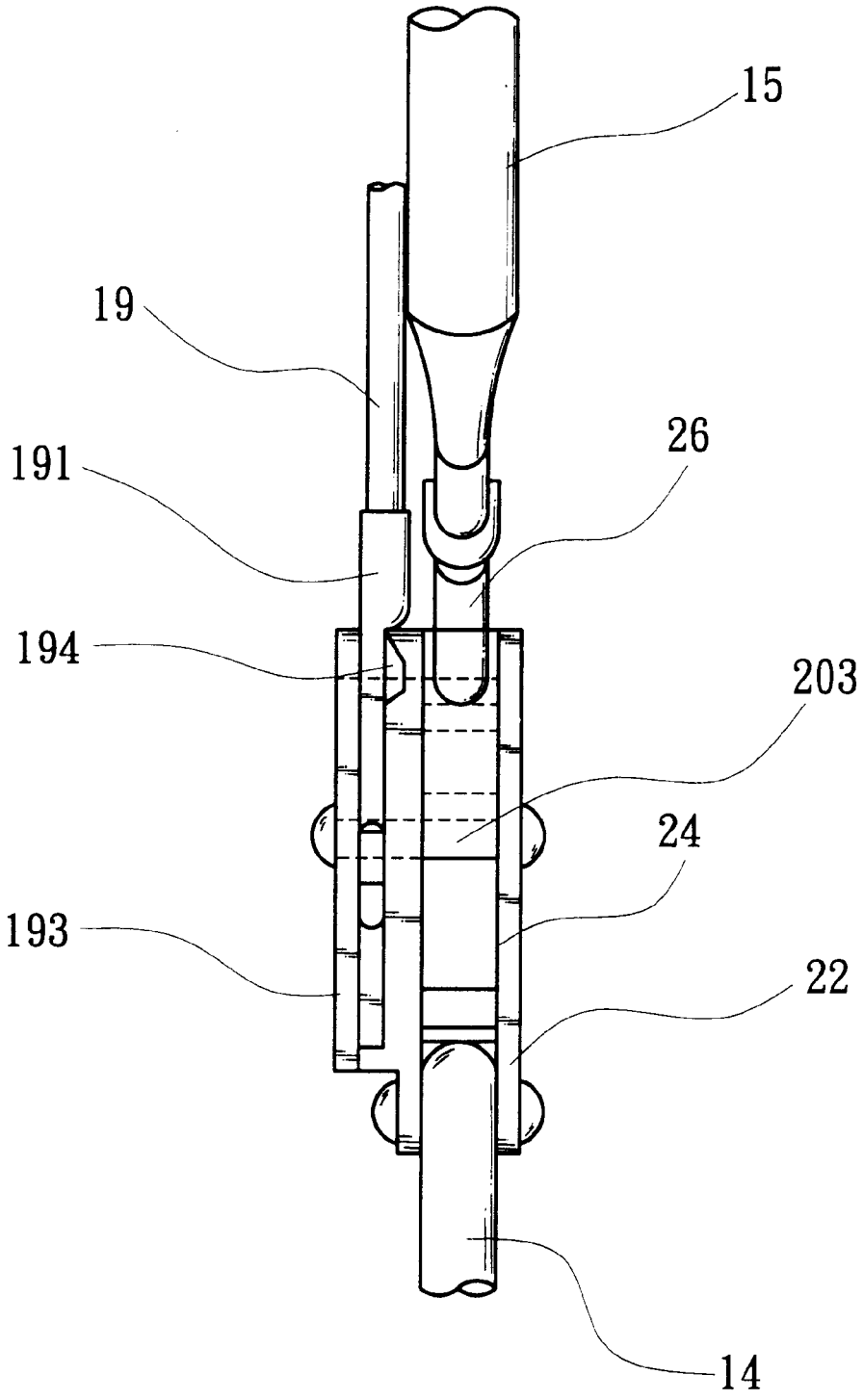
FIG. 2 is the top view of the seat back support member and the rear support member installed on the positioning part according to the present invention.
Figure 3:
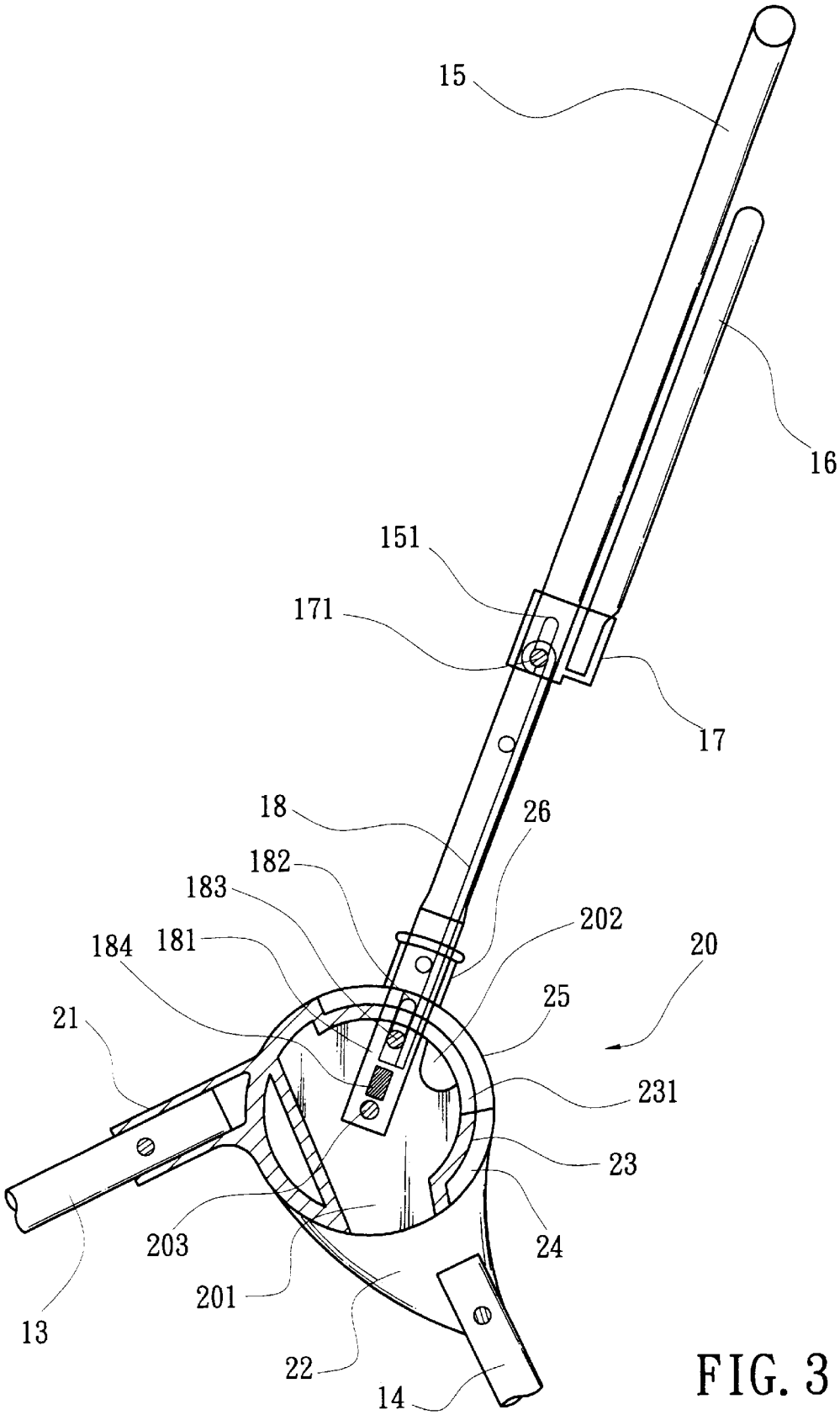
FIG. 3 is the cross-sectional view of the slider member and the seat back support member installed on the positioning part according to the present invention.

As referred to FIG. 2 and FIG. 3, the front end of the positioning part 20 takes the form of the front encasing tube 21 extending downward with an inclination. The top of the front support member 13 is inserted into the front encasing tube 21. The bottom side on the rear of the positioning part 20 takes the form of a winged member 22, which can be pivotally connected to the top of the rear support member 14. In addition, the top edge of the positioning part 20 is in a shape of an arc-shaped portion 23 with an arc-shaped slot 231 thereon. A plurality of blocking slots 202 on the top of the flank 201 in the positioning part 20 lie beneath the arc-shaped slot 231. The top portion of the positioning part 20 takes the form of a sliding slot 24 accommodated with an arc-shaped slider member 25 and the bottom end of the seat back support member 15 is inserted into the front encasing tube 26 installed on the slider member 25.

Figure 4:
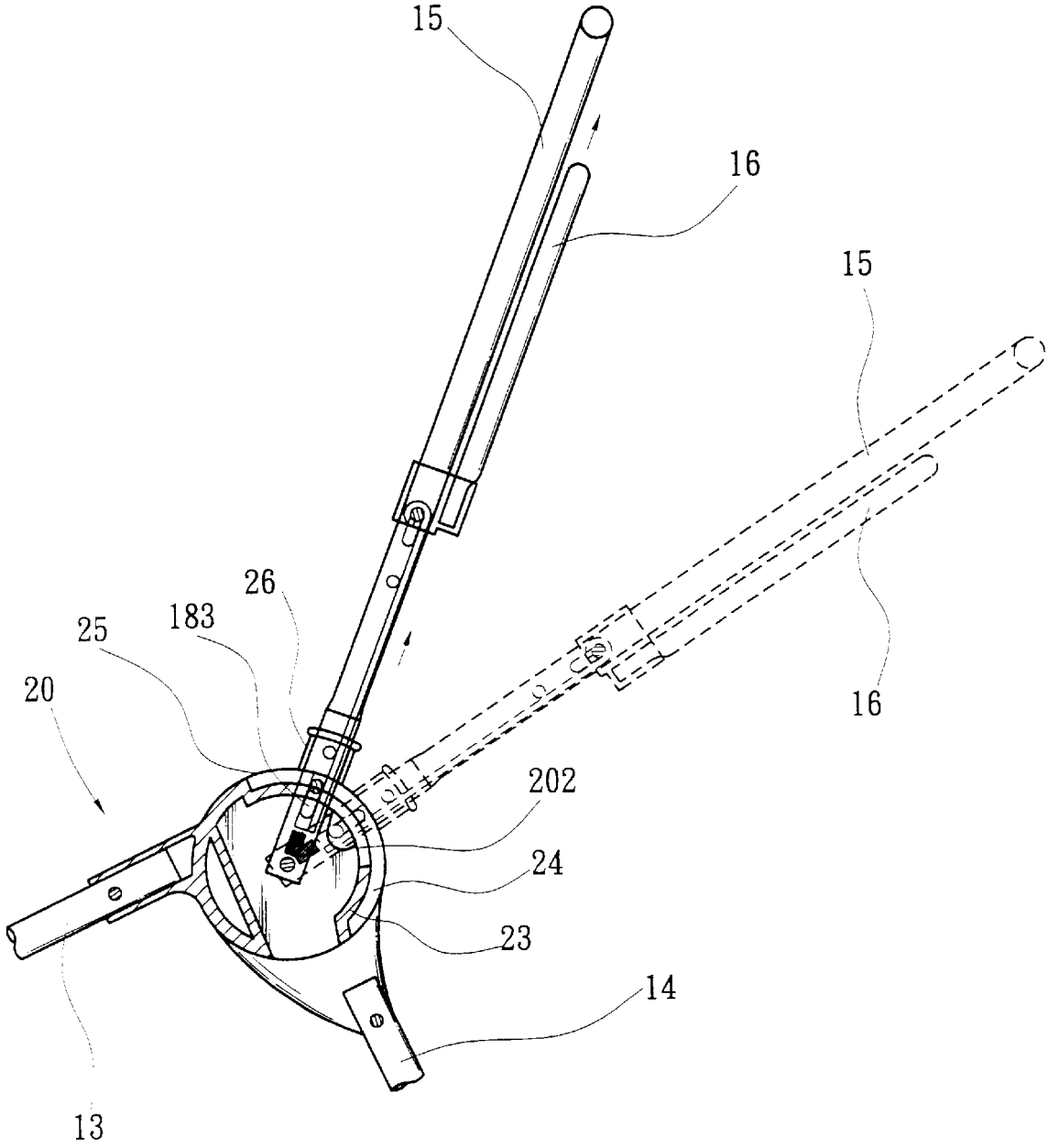
FIG. 4 is an embodied illustration on the inclination adjustment of the seat back support member in the positioning part according to the present invention.

As referred to FIG. 3, a long slot 151 adapted for use in the middle of the seat back support member 15 is past through by a shaft 171 installed on a block member 17 located outside the long slot 151. The seat back support member 15 further comprises a hook member 18 consisted of a hook portion catching the shaft 171, a vaulted handle 16 with its two wings' ends fixed onto the block member 17 and a hook plate 181 on the bottom of the hook member 18. The handle 16 can be pulled upward to actuate the block member 17 and the hook member 18. The hook plate 181 has a long through hole 182 being past through by a shaft 183 and a spring member 184 on the bottom thereof with one end catching the shaft 203 of the positioning part 20. By the design according to the present invention as referred to FIG. 4, the shaft 203 can be blocked and received by the blocking slots 20 Moreover, the handle 16 can be pulled to move the hook member 18 and lead the shaft 183 to be relieved from the blocking slots 202, through which the slider member 25 can be displaced along the sliding slot 24 and its inclination angle can be changed. That means the inclination angle of the seat back support member 15, the inclination angle of the seat back in the same time, can be adjusted by pulling the handle 16 upward as referred to FIG. 4.

Figure 5:
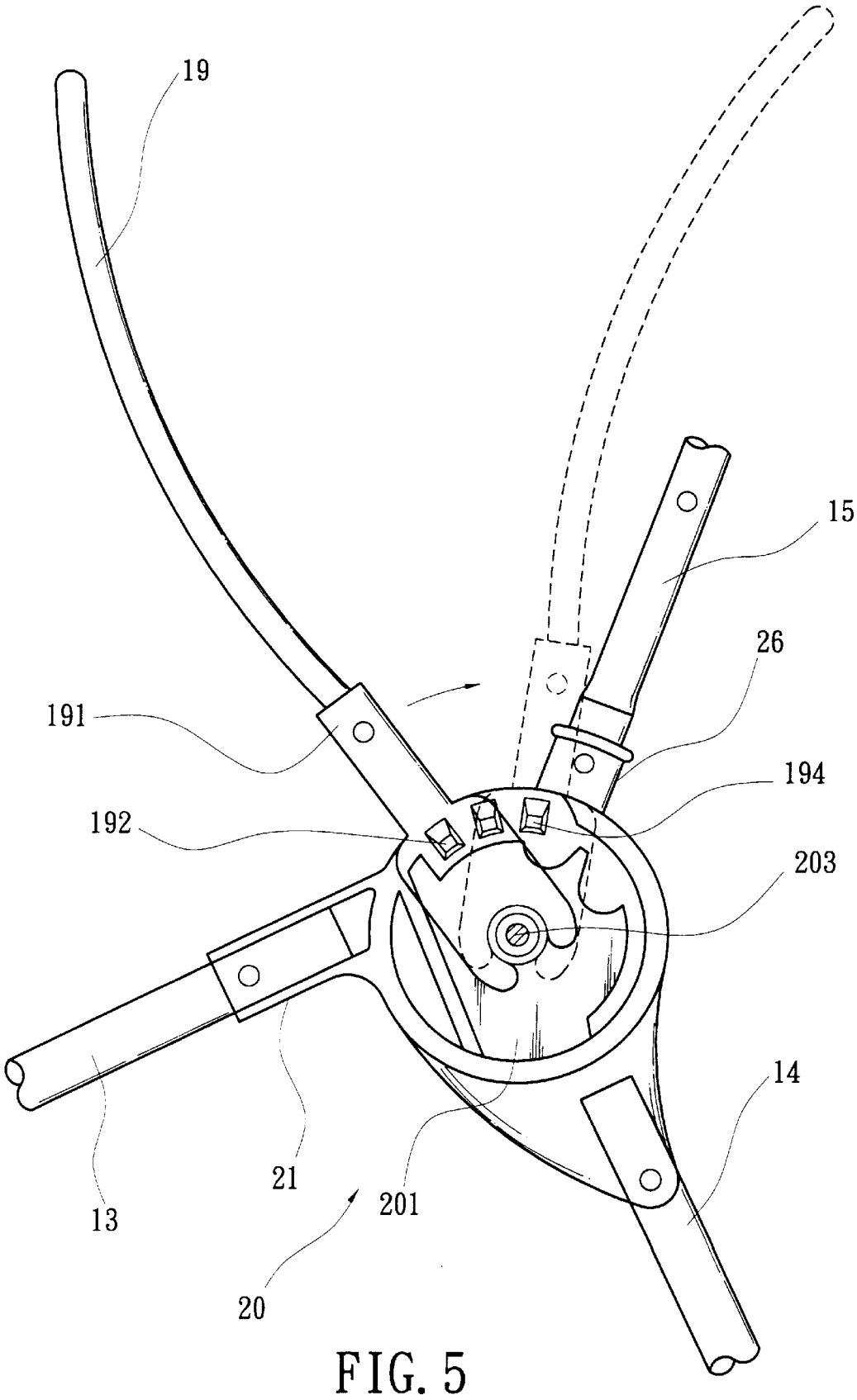
FIG. 5 is an embodied illustration on the inclination adjustment of the vaulted support member in the positioning part according to the present invention.

As referred to FIG. 2 and FIG. 5, a vaulted support member 19 installed on the positioning part 20 comprises a clamp member 191 and the hoop on the bottom of the clamp member 191 can hold the shaft 203. In addition, several protrusion points 192 mounted on the inner side of the clamp member 191 can be blocked and received by a plurality of fixation holes 194 set on the inner side of the positioning part 20. Therefore, the protrusion points 192 can be blocked fitted by different fixation holes 194 by drawing the support member 19 to change the its clamp angle in a proper manner.

Figure 6B:
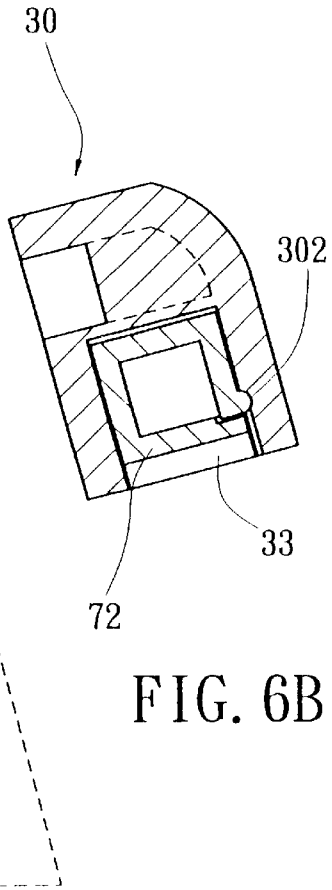
FIG. 6B is the cross-sectional view of partial FIG. 6A according to the present invention.
Figure 6A:
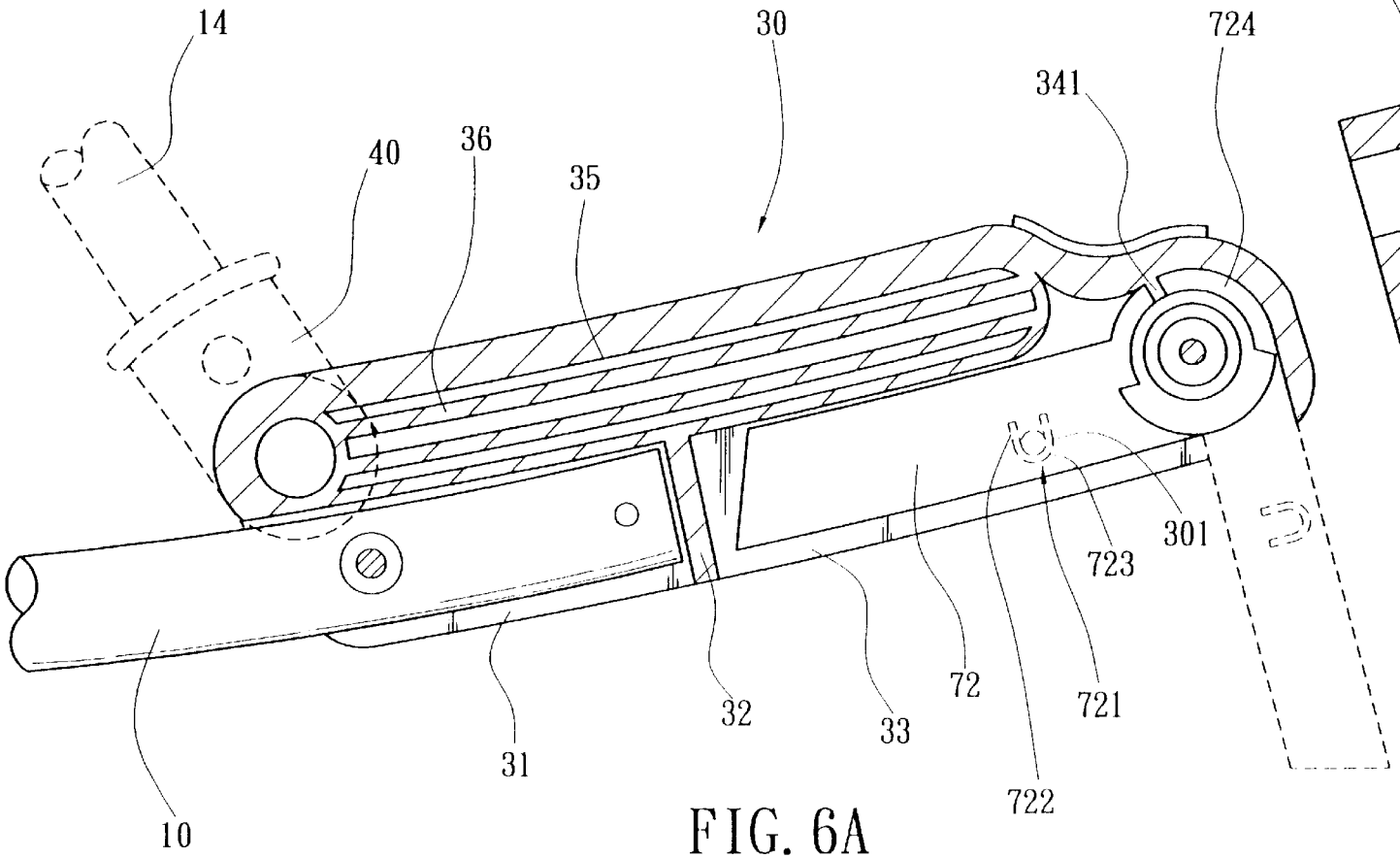
FIG. 6A is the side view of the collapsible frame and the support leg installed on the rear of the base frame support member according to the present invention.

As referred to FIGS. 6A and 6B, the collapsible frame 30 comprises an insertion slot 31 under the front thereof, an accommodation slot 33, and a separator member 32 coming between the insertion slot 31 and the accommodation slot 33. The tail of the base frame support member 10 is inserted into the insertion slot 31 and the tail end of a support leg 72 is pivoted into the accommodation slot 33. The end of the support leg 72 takes the form of an arc slot 724, and the flank of the support leg 72 takes the form of an arched breach 721. The area covered by the arched breach 721 takes the form of a resilient member 722 comprising a protrusion point 723 being matched and fixed into a fixation depression sle 302 on the end of a cut slot 301 installed on the inner side of the accommodation slot 33. The collapsible frame 30 comprises two joint block members 341 on the both rear side thereof. The joint block members 341 is also located within the an arc slot 724 on the rear end of the support leg 72, and the joint block members 341 is blocked into the tail of the joint block members 341 on the support leg 72 when the support leg 72 is stretched out downward. Moreover, a transversely stretched track 36 is set on the inner side of the upper of the collapsible frame 30 and a through slot 35 is cut through and along the track 36 in the purpose of reducing the material cost.

Figure 7:
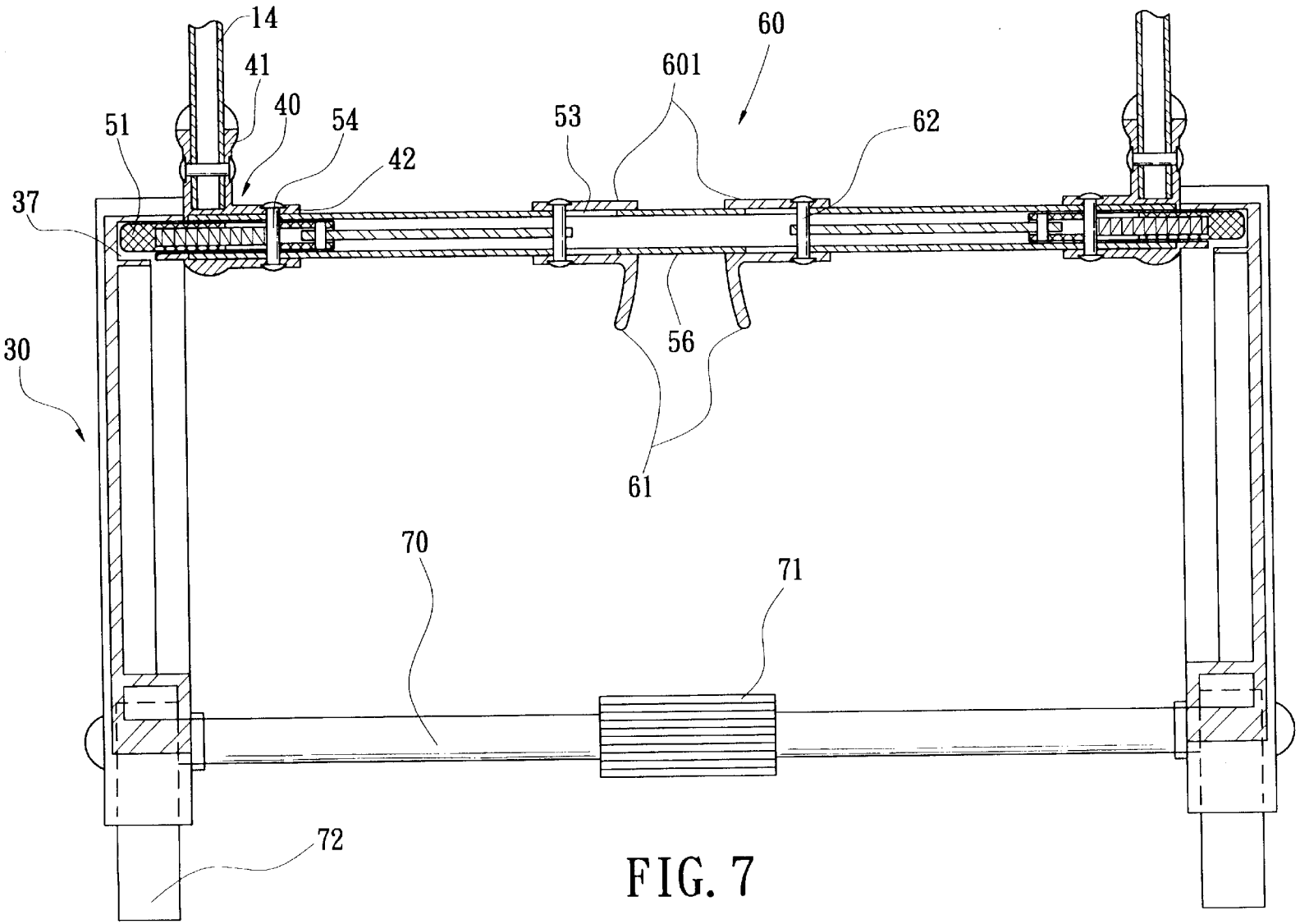
FIG. 7 is the cross-sectional view of the assembly of the insertion joint member, the pivoted joint encasing tube, the joint member, and the fixation block member according to the present invention.

As referred to FIG. 6A and FIG. 7, a collapsible device 60 installed on the end of the rear support member 14 comprises two joint block members 40. The front ends of the joint block members 40 take the form of a front encasing tube 41, and the opposite inner sides of the same take the form of a side encasing tube 42. The back support member 14 passes through and fixedly connected to the front encasing tube 41 and an insertion joint member 50 passes into the side encasing tube 42. Two transverse slots 53 are mounted opposite beside the middle of the insertion joint member 50. A pivoted joint encasing tube 601 comprising a push member 61 is pivoted to the transverse slots 53 by a shaft 62. One end of the joint member 63 is fixedly pivoted to the shaft 62, the other end fixedly mounting to the fixation block member 51. The fixation block member 51 further comprises two opposite transverse slots 511 and a spring member 52. A shaft 54 passes through the joint block members 40, insertion joint member 50, and then into the transverse slots 511 in the fixation block member 51. The end of the spring member 52 is pressed by the flank of the shaft 54.

Figure 8:
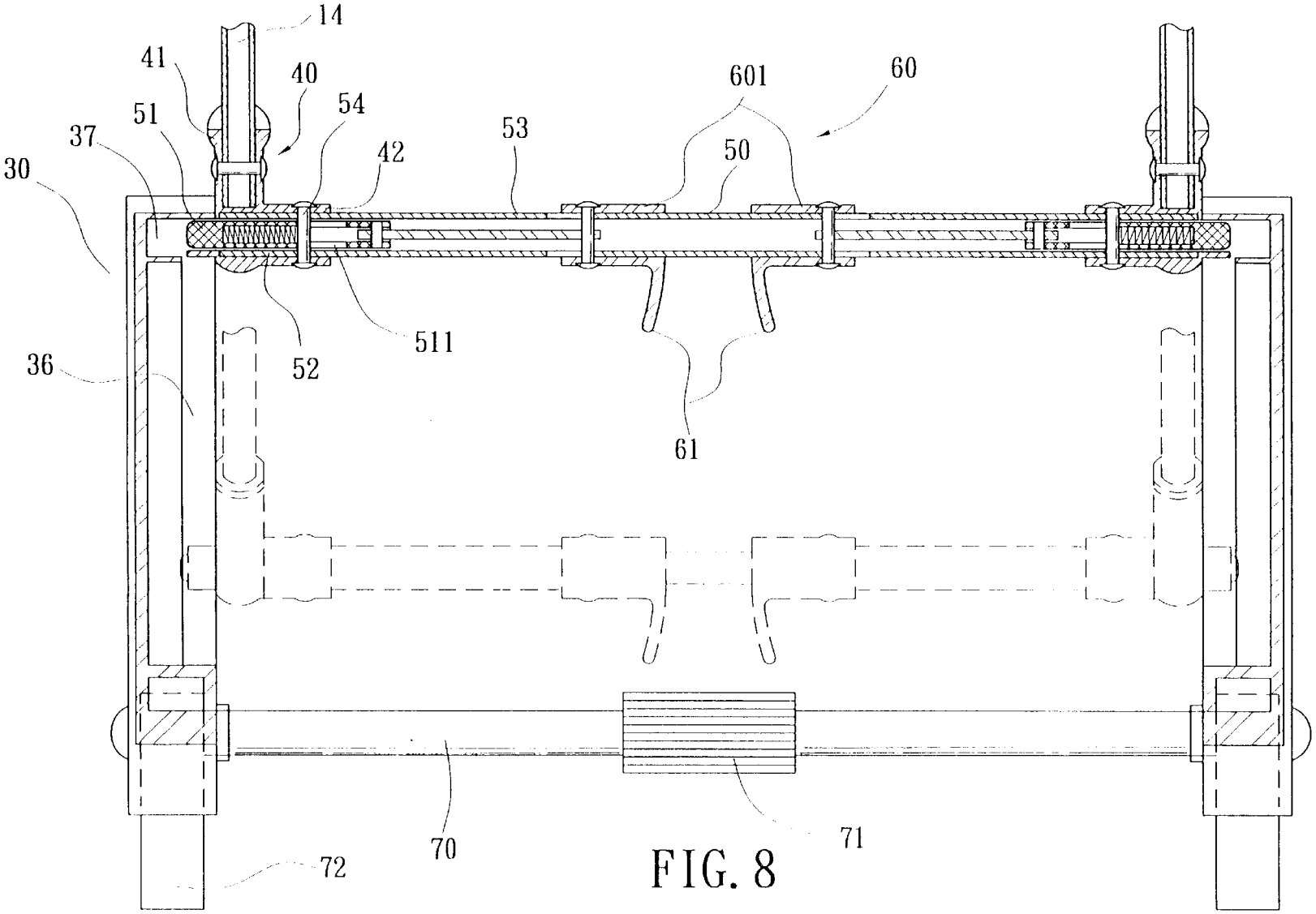
FIG. 8 is an embodied drawing illustrating the backward movement of the back support member transmitted by the pivoted joint encasing tube on the two collapsible frames according to the present invention.
Figure 9:
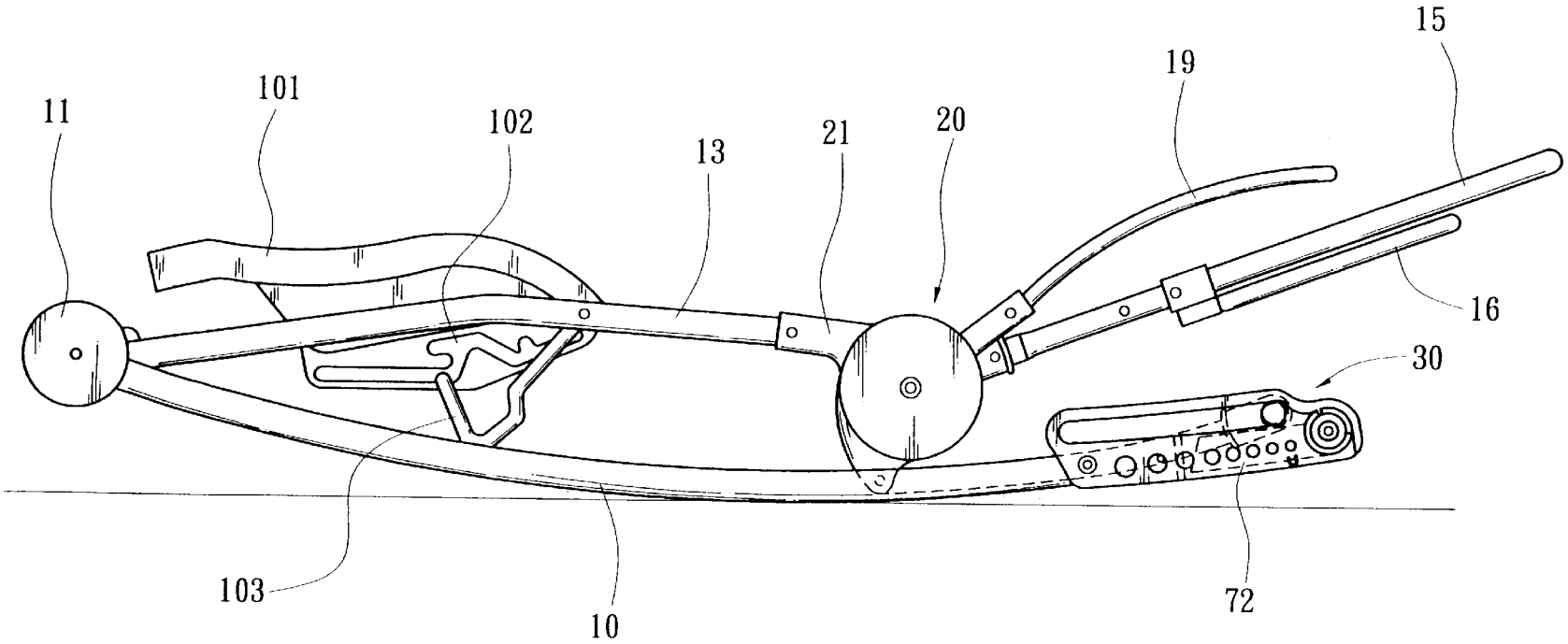
FIG. 9 is the side view on the present invention in the collapsed state.

As referred to FIG. 7, a fixation slot 37 is set on the front of the collapsible frame 30 and can be past through by the fixation block member 51. In addition, a link member 70 is adapted to connect the opposite support legs 72 also with a rotation member 71 set on the top thereof. The rotation member 71 can be turned by hands to cause the support leg 72 to be stretched out either upward or downward. As referred to FIG. 8 and FIG. 9, the user can hold and press the two push members 61 on the right and the left of the pivoted joint encasing tube 601. Then the pivoted joint encasing tube 601 can draw the fixation block member 51 and the joint member 63 to move, which can cause the fixation block member 51 to be away from the fixation slot 37 and lead the rear support member 14 along with the collapsible device 60 to move backward. Then the rocking chair 1 can be collapsed.

It can be clearly understood from the above description that the present invention is distinct from the rocking chair structure of the known art. Apart from the feasibility to adjust the inclination angle of the seat back support member 15, it is also feasible to stretch out the support leg 72 downward and the arc-shaped base frame support member 10 can be held still by the support of the support leg 72 to form an unrockable rocking chair. Therefore, the design according to the present invention has the feasibility to adjust inclination angle, the collapsibility, and the convertibility to either the rocking state or the seat state for use. The practicality and the innovation present in the invention can be more adapted for infants.

What is claimed is:

1. An infant rocking chair structure comprising:

a base frame support member, which is bent upward into an arched shape and comprise collapsible frame on a rear end of said base frame support member;

a front support member with one end pivotally mounted on a front end of said base frame support member;

a rear support member with one end displaceably mounted on said collapsible frame;

a positioning part connecting said front support member and said rear support member;

a collapsible device to convert said rear support member and said front support member into either a folded state or an unfolded state and a support bag mounted on a bottom of said collapsible frame to convert said base frame support member into a swing state or a fixed state.

2. The infant rocking chair structure according to claim 1, wherein said front support member has another end which is fixedly mounted on said positioning part.

3. The infant rocking chair structure according to claim 1, wherein said rear support member has another end which is pivotally mounted on said positioning part.

4. The infant rocking chair structure according to claim 1 which further comprises a seat back support member capable of inclining by an adjustable angle by being pivotally mounted to said support part.

5. The infant rocking chair structure, comprising:

a base frame support member, which is bent upward into an arched shape and comprises a collapsible frame on a rear end of said base frame support member;

a front support member with one end pivotally mounted on a front end of said base frame support member;

a rear support member with one end displaceably mounted on said collapsible frame;

a positioning part connecting said front support member and said rear support member;

a collapsible device to convert said rear support member and said front support member into either a folded state or an unfolded state;

a seat back support member capable of inclining by an adjustable angle by being pivotally mounted to said support part;

a front encasing tube for receiving said seat back support member;

a slider member on a bottom of said front encasing tube;

an arc plate member on a top edge of said positioning part having an arc slot therein;

a plurality of blocking slots on a flank of said positioning part;

an arc-shaped sliding slot on the top of said positioning part for receiving said slider member therein;

a hook member on said seat back support member having a handle on a tail thereof;

a hook plate member on a bottom of said hook member; and a spring member with one end thereof connected to said hook plate member and another end connected to said positioning part.

6. The infant rocking chair structure according to claim 5 wherein said seat back support member further comprises:

a long slot;

a vaulted handle comprising an encasing block member on a bottom thereof;

a shaft passing on said encasing block member which also passes through said long slot and is connected to a top of said long slot.

* * * * *